United States Patent [19]

Damico et al.

[11] 4,057,240

[45] Nov. 8, 1977

[54] EXAMINATION TABLE

[75] Inventors: Frank M. Damico, Hull; Raymond D. Nass, Stevens Point, both of Wis.

[73] Assignee: Joerns Furniture Company, Stevens Point, Wis.

[21] Appl. No.: 764,747

[22] Filed: Feb. 2, 1977

Related U.S. Application Data

[63] Continuation of Ser. No. 609,171, Sept. 2, 1975, abandoned.

[51] Int. Cl.[2] ..... A61G 13/00

[52] U.S. Cl. ..... 269/325

[58] Field of Search ..... 269/322–326; 5/62–69; 128/70–74

[56] References Cited

U.S. PATENT DOCUMENTS

| | | | |
|---|---|---|---|
| 2,827,641 | 3/1958 | Reichert et al. | 5/63 |
| 2,832,656 | 4/1958 | Perry | 269/325 |
| 3,334,951 | 8/1967 | Douglass et al. | 269/324 |
| 3,797,052 | 3/1974 | Licina et al. | 5/63 |

*Primary Examiner*—Robert C. Watson

*Attorney, Agent, or Firm*—Price, Heneveld, Huizenga & Cooper

[57] ABSTRACT

The specification discloses an examination table for supporting a patient during a medical examination including a simple, reliable, inexpensive means for adjusting the height of the table by raising and lowering a plurality of movable leg sections. Preferably, a reversible electric motor and power transfer means positioned generally below storage areas of the table cabinet operate a plurality of flexible cables directed to individual telescoping legs located at the exterior corners of the table by a plurality of pulleys. In the preferred embodiment, which includes an articulated patient support cushion, pivotal handle means are included on the movable cushion and extend to either side thereof for depression of a valve pin on a pneumatic fluid cylinder which adjusts the positions of the movable cushion section.

16 Claims, 12 Drawing Figures

EXAMINATION TABLE

CROSS REFERENCE TO RELATED APPLICATION

This is a continuation of application Ser. No. 609,171, filed Sept. 2, 1975, now abandoned.

BACKGROUND OF THE INVENTION

This invention relates to examination tables for supporting patients during medical examinations and, more particularly, to an examination table having a simple, reliable, inexpensive height-adjusting mechanism for raising and lowering the table and means for positioning a portion of an articulated patient support cushion.

Conventional medical examination tables especially adapted for use by physicians in offices and clinics to support patients during various types of medical examinations are typically either fixed-height or adjustable-height type tables. Adjustable height examination tables are desirable because various types of medical examinations are most expeditiously carried out at different heights. Prior adjustable tables have used different apparatuses for raising and lowering the tables with respect to a support surface.

One particular prior known height-adjusting mechanism is shown in U.S. Pat. No. 3,34,951 issued Aug. 8, 1967, to Douglass, Jr., et al., entitled EXAMINING TABLES. Disclosed therein is an electric motor rotating a vertically positioned screw shaft. An elevating arm is mounted on the screw shaft and connected to the table frame via a threaded nut. Rotation of the shaft raises and lowers the nut, the elevating arm, and table.

Another prior known height-adjusting mechanism is shown in U.S. Pat. No. 3,348,893, issued Oct. 24, 1967, to Katzfey et al., entitled PHYSICIAN'S EXAMINING TABLE. Included are four parallel lever arms pivotally connected between a pedestal base and the underframework of the supported table. A fluid cylinder is connected to the structure to pivot the upper table portion about the lever arms in a vertically swinging arc to raise and lower the table.

Although these specific tables and other examining tables including height adjustment mechanisms function adequately, they are extremely expensive to manufacture and maintain due to the complexity and number of necessary parts. Moreover, certain of the prior structures include exposed operating mechanisms which could cause injury. Access to the operating mechanisms for maintenance or repair is typically difficult and time consuming. Also, in many tables, valuable storage space within the cabinet storage areas is taken up by the necessary bulk of the operating mechanism.

Many prior examination table structures have also included a patient support cushion which is articulated to support the patient in various positions for examination. Control of mechanisms for positioning the cushions has typically been obtained from a single control area on the table. When this control area is on one or the other side of the table and the examining physician or other medical personnel wish to raise or lower the cushion section, it has been extremely inconvenient to move to the single control area to change the position of the patient support.

SUMMARY OF THE INVENTION

Accordingly, the present invention provides an adjustable-height examination table especially adapted for supporting a patient during a medical examination. The table includes a simple, reliable, inexpensive, height-adjusting mechanism which raises and lowers the entire table. The table includes a plurality of legs each having a movable leg section connected to flexible connector means leading from a power unit to the legs. The power unit, flexible connectors, and other portions of the height-adjusting apparatus are positioned generally at the corners and below to provide large, easily accessible storage areas. The flexible connectors are extended and retracted by the power unit to raise and lower the table on the movable leg sections.

In the preferred embodiment, the legs are positioned for easy access at the exterior corners of the table. They include telescoping, movable sections which are operated by separate, flexible, braided wire cables extending from a power transfer means on the power unit individually to each of the legs by means of a plurality of pulleys for each cable. Movement of a single connector member in the power transfer means simultaneously extends and retracts each of the cables to raise and lower the table.

In another aspect of the invention, the table includes an articulated patient support cushion having a generally vertically pivotable cushion section. The cushion position is controlled with a fluid cylinder pivotally interconnected between the movable cushion section and the top of the table cabinet on which the cushion is mounted. A handle extends to either side of the cushion for operation from either side and is movable with the cushion. The handle is pivotable to depress a valve control member on the fluid cylinder. The valve member controls the position of a piston within the cylinder and thus the position of the cushion section.

The present height-adjusting mechanism provides a significant cost reduction over prior known mechanisms included in other examination tables. The power unit and power transfer apparatus are suspended under the table cabinet for easy access, removal and repair. The movable leg sections are exposed at the exterior corners of the table such that virtually the entire height-adjusting mechanism can be repaired or adjusted easily and quickly. The position of the operating mechanism allows efficient use of the entire cabinet. Further, the cushion control handle provides convenient control of a patient's position from either side of the table.

These and other objects, advantages, purposes, and features of the invention will become more apparent from a study of the following description taken in conjunction with the drawings.

DESCRIPTION OF THE PREFERRED EMBODIMENT

Figure 1:
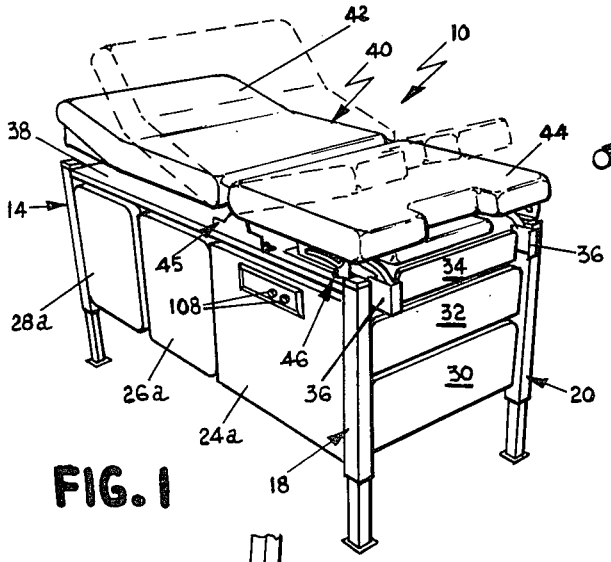
FIG. 1 is a perspective view of the examination table of the present invention taken from the foot end of the table.
Figure 7:
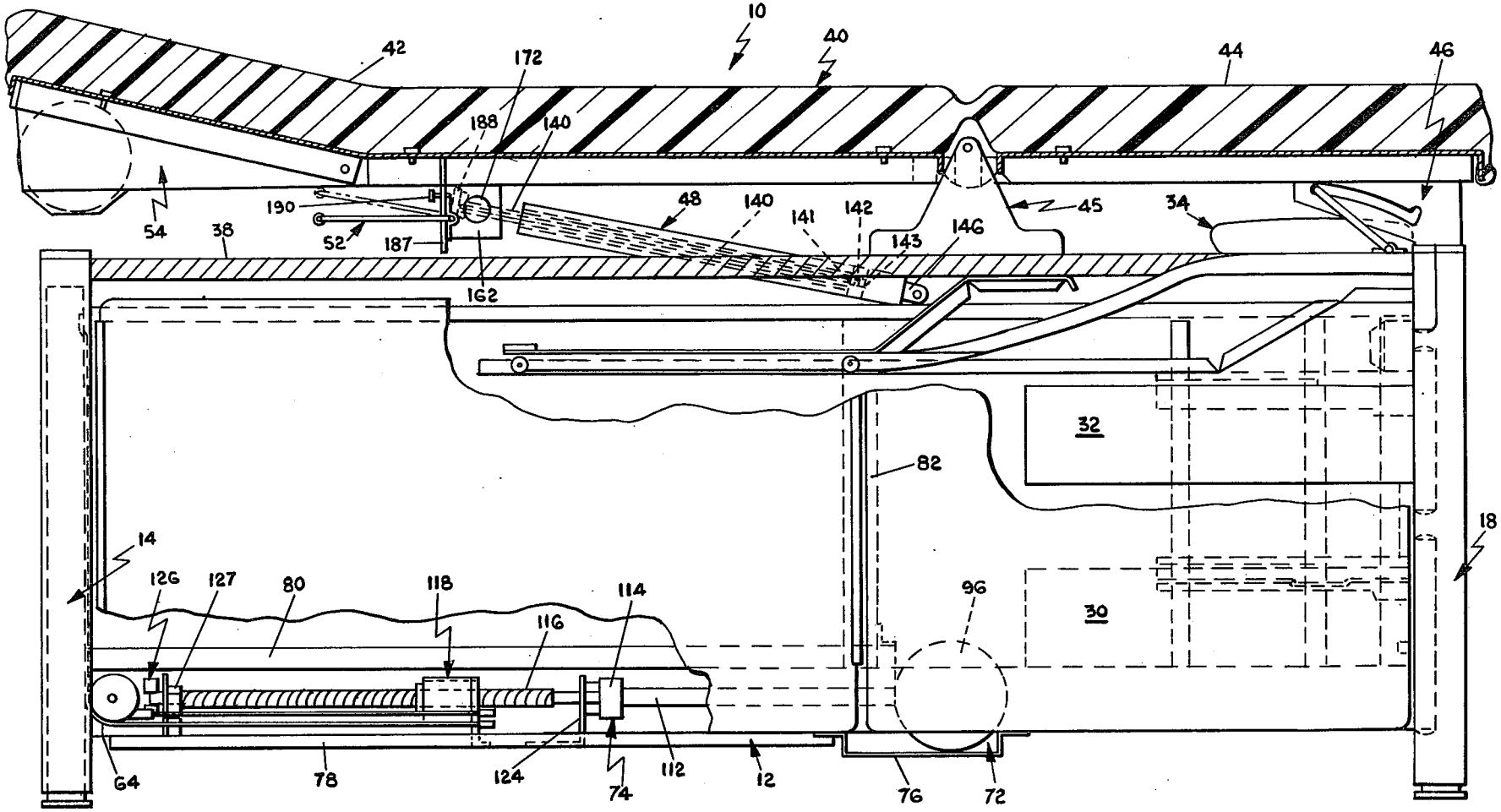
FIG. 7 is a sectional, side elevation of the entire examination table illustrating the location of the power unit and power transfer means with respect to the movable legs and storage areas thereof.

Referring now to the drawings in greater detail, FIGS. 1 and 7 illustrate the overall assembly of examination table 10 of the present invention. Table 10 includes a generally rectangular supporting framework 12 (FIG. 3) including four generally vertically upstanding support legs 14, 16, 18, and 20, one at each exterior corner of the support frame. Mounted atop the support frame 12 and generally between the upstanding support legs 14–20 is a table cabinet 22. Cabinet 22 includes stationary side wall panels 24*a* and 24*b* on either side of the foot end of the cabinet and hinged side wall panels 26*a* and 26*b*, and 28*a* and 28*b* at the head end of the cabinet.

Extendibly mounted at the foot end of the cabinet between the fixed side wall panels 24*a*, 24*b* are a pair of vertically aligned drawers 30, 32, mounted one above the other, as well as an extendible, combination leg rest-drainage pan carriage assembly 34 mounted vertically above drawer 32. A pair of extendible foot stirrup assemblies 36 are mounted one one either side of the extendible leg rest-drainage pan carriage assembly. A top panel or cabinet wall 38 (FIGS. 7 and 8) is mounted horizontally over the top of the cabinet 22 adjacent the top surfaces of the legs. An articulated patient support cushion 40 including a vertically pivotal cushion head section 42 and a vertically pivotable cushion seat section 44 is mounted atop the cabinet top wall 38 on bracket assemblies 45. At the underside of the foot end of the seat section 44 is mounted an over-center type seat section positioning assembly 46 which allows the seat section to be positioned angularly upwardly for pelvic examinations. Beneath head section 42, and pivotally between that section and the top wall 38 of the cabinet 22, is mounted a fluid cylinder 48 and control means 50 including a handle extending to either side of the articulated head section 42 for control of the fluid cylinder position. A molded paper tray 54 for holding rolls of disposable paper for covering cushion 40 is hingedly fastened beneath the upwardly angled, head support area of head section 42.

The above-mentioned features, including the articulated patient support cushion 40, pivot brackets 45, over-center seat section positioning bracket 46, extendible leg rest-drainage pan carriage assembly 34, paper tray 54, and certain other portions of the examination table are more fully described in copending United States patent application Ser. No. 609,172 invented by Warren J. Peterson, filed on even date herewith, assigned to the same assignee of the present invention, the disclosure of which is hereby incorporated by reference herein.

Figure 2:
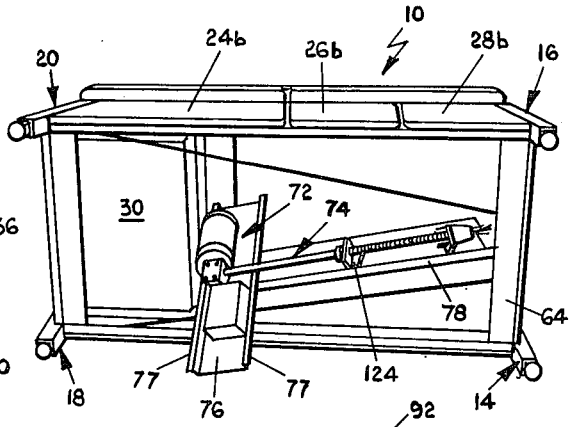
FIG. 2 is a perspective view of the bottom of the examination table with the support pan for supporting the power unit and power transfer means removed from its normal position.
Figure 3:
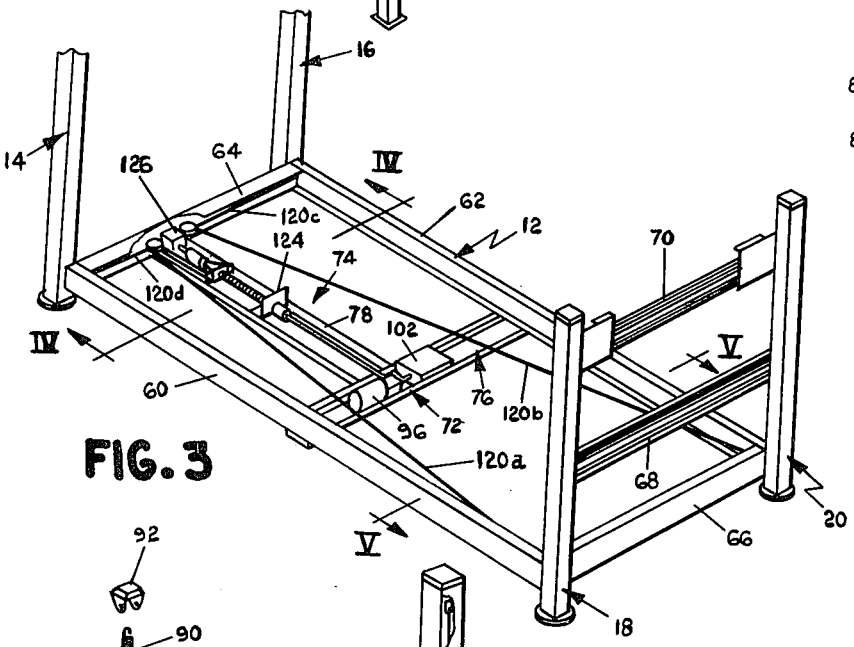
FIG. 3 is a fragmentary, perspective view of the height-adjusting mechanism and examination table framework illustrating the power unit, power transfer means, the height-adjusting legs, and flexible connectors extending to each leg.

With reference to FIGS. 2–6 and 10–12, the height-adjusting mechanism of the present invention will be more fully described. As shown in FIG. 3, framework 12 includes a pair of elongated, side channel members or rails 60 and 62 extending between legs 14, 18, and 16, 20, respectively. At the head end of the table is welded or otherwise secured a cross channel 64 extending between legs 14 and 16 and side rails 60, 62. At the foot end is a channel member 66 extending between side rails 60, 62 as well as a pair of additional channel members 68 and 70 spaced vertically above the channel member 66 and between legs 18 and 20. Additional side or end channel members may be included near the top ends of legs 14–20 for additional support of the cabinet.

As is best seen in FIGS. 2, 3, 7, and 10, the power unit 72 and power transfer means 74 connected to the power unit are supported in adjoining support pans 76 and 78, respectively, stamped from sheet metal or the like. Power unit 72 is generally centrally located in the recessed central portion of pan 76. Pan 76 is in turn secured to the underside of side rail 60, 62 with suitable threaded fasteners or the like by means of parallel lateral side flanges 77 offset from the depressed central section. Similarly, power transfer means 74 is mounted along the length of the central depressed portion of support pan 78. Pan 78 is secured by its offset lateral side flanges 79 and threaded fasteners between lateral side flange 77 closest to the head end of the table on pan 76 and the underside of cross member 64.

As is best seen in FIG. 7, the cabinet 22 includes a floor or bottom wall 80 in the head end of the cabinet as well as an internal vertical partition 82 extending between bottom wall 80 and top wall 38 as shown therein. When mounted in the support pans 76, 78, the power unit 72 and power transfer means 74 are supported generally beneath the storage areas under bottom wall 80 with only a portion of the electric motor 96 projecting to the level of bottom wall 80 between partition 82 and the rear walls of drawers 30, 32. Since the power apparatus is secured to the frame 12, it travels with the table as its height is adjusted vertically. Yet, it is positioned generally below any storage areas above bottom wall 80 access to which is provided by hinged side wall panels 26, 28.

Figure 6:
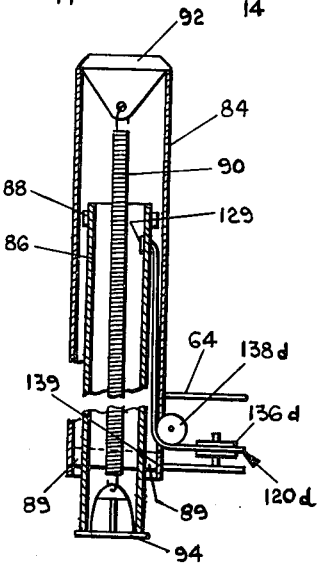
FIG. 6 is a sectional view of one of the support legs illustrating the telescoping movable leg section and the connection of a flexible cable thereto.
Figure 4:
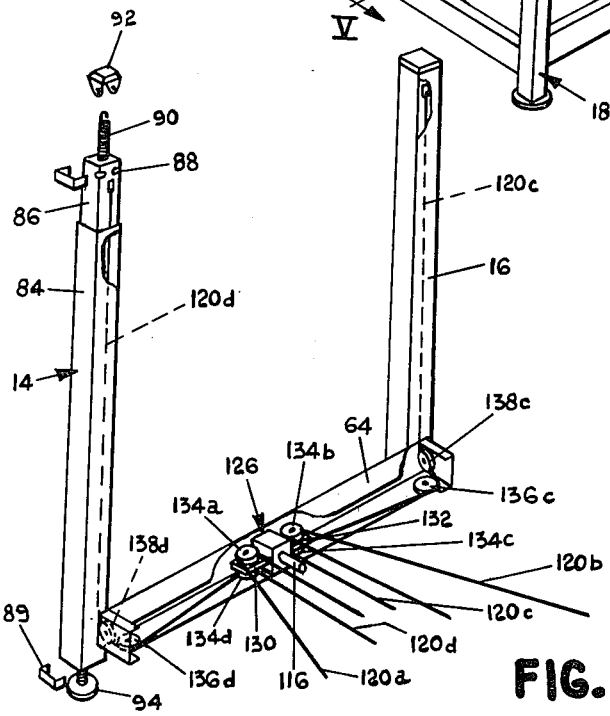
FIG. 4 is a fragmentary, perspective view of the pair of legs at the head end of the table shown in FIGS. 1–3 with the parts of one of the legs shown in exploded fashion.

As is best seen in FIGS. 4 and 6, each of the legs 14–20 at the exterior corners is a telescoping assembly. Positioning the legs at the exterior corners provides ease of access for maintenance and repair, saves cabinet space for storage, and stabilizes the support of the table. For purposes of explanation, leg 14 will be described although the remaining legs are substantially identical. Leg 14 includes a vertically extending tubular section 84 fixed to framework 12 and cabinet 22 and having a square, cross-sectional shape. Telescoped within tube 84 from its lower end is a smaller, vertically movable leg section 86 also having a square cross-sectional shape. Press fitted about the upper end of tube 86 and movable therewith are a pair of generally U-shaped nylon or other plastic spacers 88 which position the tube 86 within tube 84 but allow it to slide therewithin. A similar pair of nylon or other plastic spacers 89 are fixedly positioned within the lower end of tube 84 to guide the lower end of tube 86. An elongated coil spring 90 extends between a top end cap 92 and a lower foot member 94 to bias the same against the ends of leg tubes 84, 86, respectively.

Figure 10:
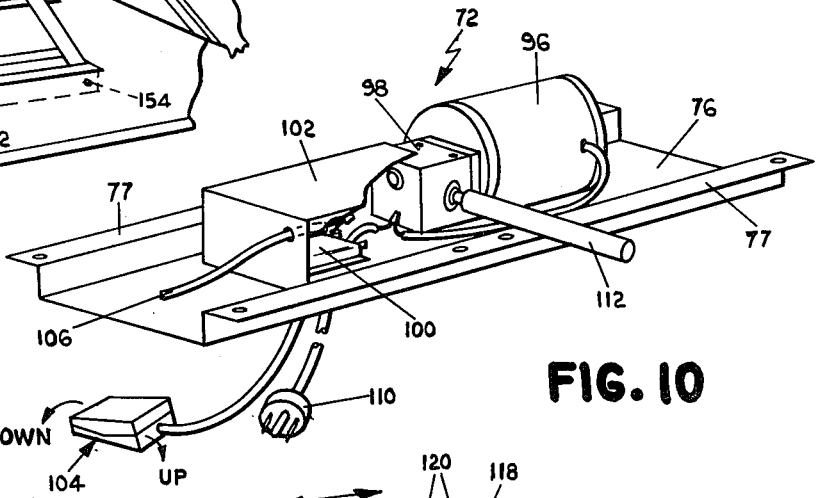
FIG. 10 is a fragmentary, perspective view of the power unit support apparatus with portions broken away to illustrate the control circuitry for the power unit.
Figure 11:
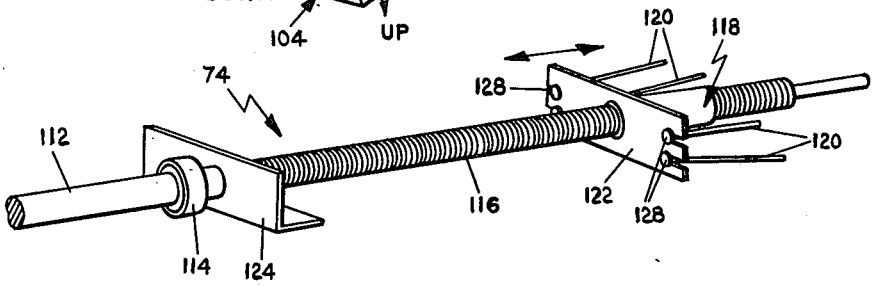
FIG. 11 is a fragmentary, perspective view of the power transfer means for extending and retracting the flexible cables.
Figure 12:
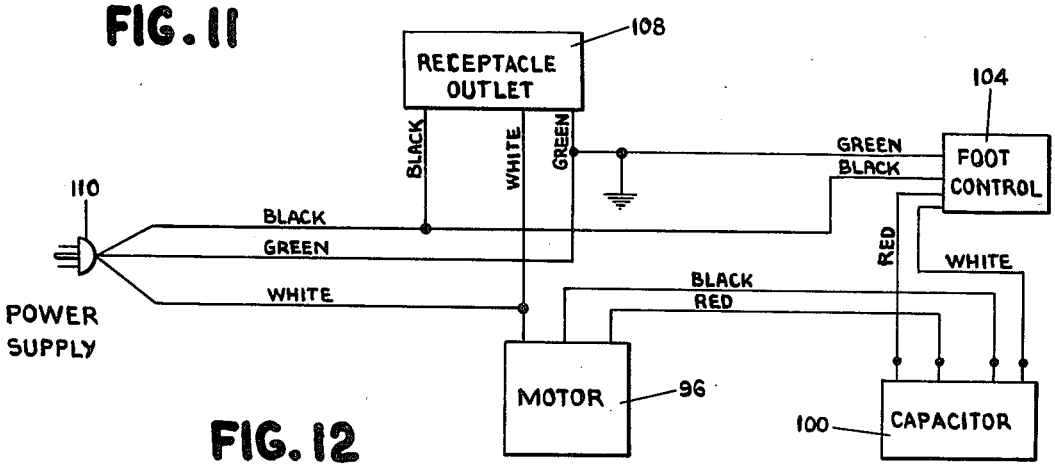
FIG. 12 is a schematic illustration of the electrical control circuit for the height-adjusting mechanism.

Power unit 72 includes a reversible electric motor connected to a speed reduction gear box 98 (FIGS. 2, 3, and 10). A capacitor 100 mounted within a housing 102 is connected by appropriate wiring between pendant, foot-operated, floor-mounted, motor-reversing switch control 100 and motor 96. Also included in the circuitry (FIG. 12) is appropriate wiring 106 leading to an external receptacle outlet 108 mounted on fixed side wall panel *24a* as shown in FIG. 1. A grounded, three-prong plug 110 is provided for insertion in a 110 volt supply to supply power to the circuit.

Power transmission unit 74 includes a drive shaft 112 (FIGS. 10 and 11) connected to reduction gear box 98 (FIG. 10). Drive shaft 112 is connected through a conventional multidisc slip clutch 114 to an elongated screw 116. An internally threaded connector member 118 is mounted for axial movement along the length of screw 116 for extension and retraction of a plurality of flexible cables 120 secured to the extending flanges 122 thereof. Drive shaft 112 and screw 116 are supported for rotational movement by the power unit 72 with an L-shaped bracket 124 secured at approximately the middle of pan 78 (FIG. 2 and 3) and a bearing and pulley mounting block 126 mounted within frame cross member 64 (FIGS. 3, 4, and 7). A thrust bearing 127 (FIG. 7) is included between the end of screw 116 and bearing block 126 to accommodate axial force exerted thereagainst by the relative motion between connector member 118 and screw 116.

Figure 5:
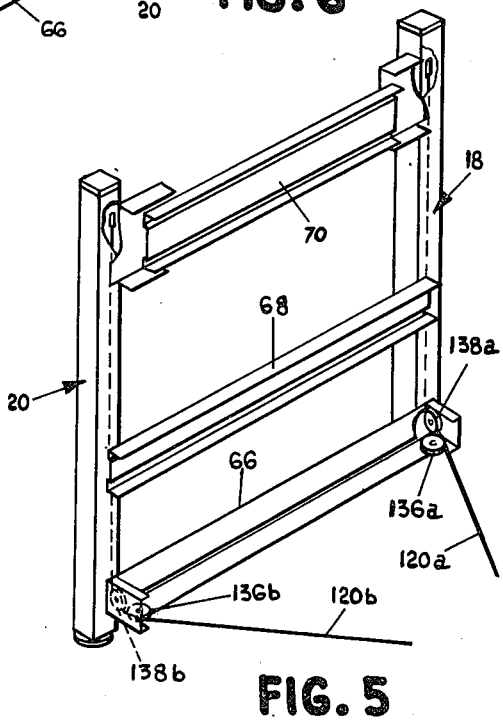
FIG. 5 is a fragmentary, perspective view of the pair of legs at the foot end of the examination table.

As shown in FIGS. 3–5, an elongated, resilient, flexible cable 120 is connected between the connector member 118 and each of the legs 14–20 via a plurality of pulleys. Preferably, each cable 120 is formed from braided metallic wire or the like such that the cable is substantially non-stretchable in the longitudinal direction although it may be easily flexed in various directions for connection to a leg. Each cable includes a cable end member 128 which is enlarged and retains the cable end of connector member 118. At the opposite end is a cable end member 129 which fits within an aperture at the upper end of leg tube 86 (FIG. 6). Intermediate the ends of each cable, the cable passes over three pulleys which direct it to one of the four legs at each exterior corner of the table.

Bearing block 126, which includes a conventional bearing 127 supporting the end of screw 116, also includes two generally horizontal, oppositely extending flanges 130 and 132 (FIG. 4) each of which support vertically aligned rotatable pulleys 134*a*–134*d.* Mounted within each end of each cross member 64, 66 are a pair of rotatable pulleys 136 and 138 which direct the cables to the legs (FIGS. 4, 5, and 6). Pulleys 136 are mounted on vertical axes such that they rotate in a horizontal plane while pulleys 138 are mounted on horizontal axes and rotate in a generally vertical plane.

As shown in FIG. 4, cables 120*a* and 120*b* engage upper pulleys 134*a,* 134*b* and are directed rearwardly at an angle from bearing block 126 to pulley sets 136*a,* 138*a* and 136*b,* 138*b* in cross member 66 at the foot end of the table. Cables 120*a,* 120*b* extend above pans 76, 78 but below bottom cabinet wall 80. Cables 120*c* and 120*d* are directed around lower pulleys 134*c,* 134*d* on bearing block 126 and through the interior of channel 64 to the pulley sets 136*c,* 138*c* and 136*d,* 138*d* in cross member 64 at the head end of the table. After passing around the horizontal and vertical pulleys, the respective cables each pass through an aperture 139 (FIG. 6) in the outer tubes 84 of their respective legs at the lower end thereof and extend vertically upwardly between tubes 84, 86 to an aperture engaged by cable end member 129 near the top of the inner tube 86 of each leg.

In operation, when plug 110 is inserted in an appropriate power supply, and pendant foot control switch 104 is pivotally depressed in the up or down direction (FIG. 10), motor 96 rotates drive shaft 112 and screw 116 to move connector member 118 axially along screw 116. Depending on the direction in which motor 96 is rotating screw 116, connector member 118 will be moved toward or away from power unit 72 thereby extending or retracting cables 120. When switch 104 is moved to its up position, connector member 118 is drawn toward power unit 72 and cables 120 are retracted causing the length of the vertical extension of the cables between pulleys 138 and the apertures at the top of internal tubes 86 of each leg to be shortened. This draws each of the leg tubes 84 upwardly as guided by guides 88 and 89. Since all four cables 120 are retracted simultaneously, outer leg tubes 84, and thus cabinet 22 and cushion 40, are raised simultaneously such that the height of the entire table is changed vertically upwardly simultaneously. Upon reversing the direction of rotation of motor 96 by pivoting switch 104 to its down position, connector member 118 will be moved away from the power unit and the cables extended thereby lowering the table in the reverse manner.

Figure 8:
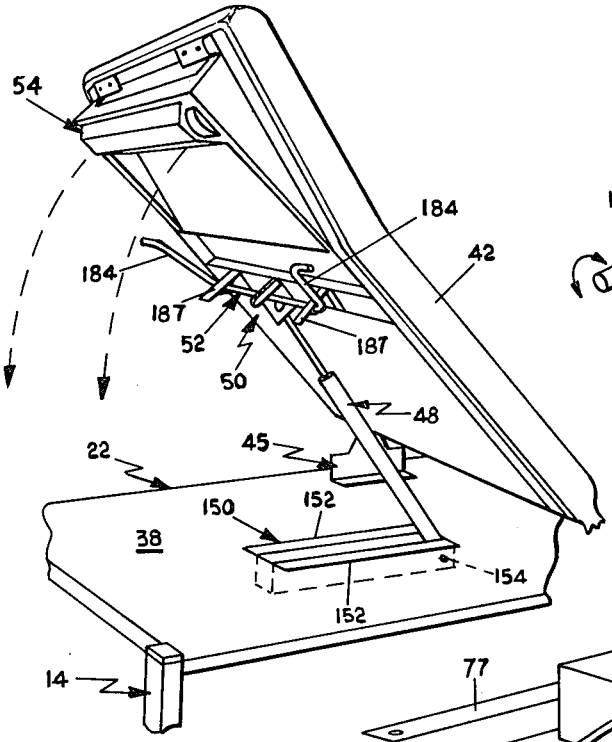
FIG. 8 is a fragmentary, perspective view of the underside of the articulated head section of the patient support cushion showing the pivotable handle for controlling the fluid cylinder which postions the articulated section.
Figure 9:
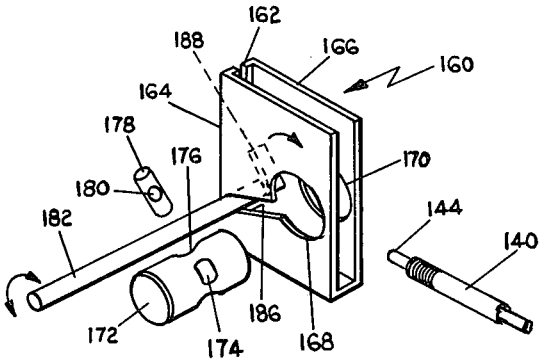
FIG. 9 is an exploded, perspective view of the connection of the fluid cylinder connecting rod to the underside of the articulated support cushion section.

Referring now to FIGS. 7–9, control of the position of the articulated head section 42 of patient support cushion 40 is obtained with fluid cylinder 48 and control means 50 including handle 52. Fluid cylinder 48 is a pneumatic cylinder preferably filled with nitrogen gas and including a connecting rod 140 extending out of the upper end of cylinder 48 and joined to an internal piston 142 within the cylinder. Extending axially along and centrally within connecting rod 140 is a push pin 144 which controls a valve 143 within piston 142 allowing nitrogen gas to pass from one side of the piston to the other within the cylinder. When the valve is opened by means of depression of push pin 144 (FIG. 9), the piston is allowed to move within the cylinder since nitrogen gas can pass through the piston and builds up pressure on one side or the other of the piston. However, when pin 144 is not depressed, the valve is closed and gas cannot pass through piston 142 which is therefore held in one position within the cylinder. Cylinder 48 includes a biasing spring 141 therewithin to urge push pin 144 to its extended position thereby normally closing the valve in the piston to hold it in one position within the cylinder. Preferably, cylinder 48 is of the rigid blockage type sold under the trademark "BLOC-O-LIFT" by Stabilus GmBH of Koblenz, West Germany, Model No. 06-10-180-310, and more fully described in Stabilus publication BOC 8.72 2000, incorporated by reference herein.

The lower end of cylinder 48 includes a flange 146 which is pivotally secured within a mounting pan 150 in the top wall 38 of cabinet 32 (FIG. 8). Mounting pan 150 has a generally U-shaped, cross-sectional shape and includes a pair of lateral flanges 152 extending along its upper edges for securing the pan to the top surface of top wall 38. A pivot pin 154 extends between the generally parallel downwardly extending side walls of pan 150 and passes through flange 146 to pivotally secure the cylinder 48 in the pan.

The upper end of cylinder 48 is pivotally secured to the underside of approximately the middle of articulated head section 42 by means of a bracket assembly 160. Assembly 160 includes a bracket 162 having parallel side walls 164, 166 including aligned circular apertures 168, 170, respectively. A clevis pin 172 in the form of a right circular cylinder is passed through aligned apertures 168, 170 and receives the end of connecting rod 140 through a transversely extending aperture 174. Cylinder 172, which is preferably formed from steel, includes a second aperture extending therethrough transverse to the direction of aperture 174 and intersecting aperture 174. Aperture 176 receives cylinder pin 178 including a threaded aperture 180 into which the threaded end of connecting rod 140 is secured. Hence, clevis pin 172 holding rod 140 of cylinder 48 can pivot within bracket 162 while push pin 144 projects through clevis cylinder 172 for actuation via the control means 50 and handle 52 in the manner described below.

Handle 52 includes a rectilinear central section 182 and curved gripping portions 184 on either end thereof. Central section 182 is passed through aligned slots 186 which communicate with apertures 168, 170 in side walls 164, 166 of bracket 162. On either side of bracket 160, handle section 182 is supported by support brackets 187 secured to the underside of head section 42. Between the side walls 164, 166 and fixedly secured to central section 182 of handle 52 is a push pin engaging member 188. Accordingly, as handle 52 is pivoted upwardly toward the underside of head section 42, engaging member 188 is rotated to depress push pin 144 to open valve 143 in piston 142. This allows the position of piston 142 and head section 42 to be changed. An adjustable threaded stop member 190 (FIG. 7) threaded in the rear wall of bracket 162 limits the return movement of member 188 and thus handle 52 by the biasing force of spring 141 within cylinder 48.

When valve 143 is opened and rod 140 is in retracted position, gas movement within cylinder 48 extends rod 140 and exerts anywhere from approximately 80 to 100 pounds force outwardly to help raise head section 42. When extended, valve 143 can be opened and head section 42 will return to its lowered position by pressing down and using the weight of a patient leaning on head section 42. The cylinder thus counterbalances the patient's weight and holds in position as desired. Thus, articulated head section 42 is raised while handle 52 is pivoted upwardly toward its underside to position the back of a patient supported by the patient support cushion 40. Should the back of the patient need to be lowered, the attending person need only to pivot handle 52 upwardly while the weight of the patient forces piston 142 toward the lower end of cylinder 48 via connecting rod 140. When valve 143 is closed by releasing the handle 52, the piston position remains unchanged.

While one form of the invention has been shown and described, other forms will now be apparent to those skilled in the art. Therefore, it will be understood that the embodiment shown in the drawings and described above is merely for illustrative purposes, and is not intended to limit the scope of the invention which is defined by the claims which follow.

The embodiments of the invention in which an exclusive property or privilege is claimed are defined as follows:

1. A variable height examination table for supporting a patient during a medical examination comprising: a cabinet including a top, a bottom, side walls and end walls defining storage space within said cabinet; a leg at each corner of said cabinet, generally at the junctures of said side and end walls whereby said legs do not interfere with said storage space of said cabinet, for supporting said cabinet on a support surface; patient support means mounted on said top of said cabinet, outside said storage space of said cabinet, for supporting a patient; each of said legs including a stationary section adapted to rest on the support surface and a vertically movable section; and motive power means for raising and lowering said vertically movable leg sections, and thus said cabinet and patient support means, with respect to said stationary leg sections; said motive power means including a power unit mounted beneath said bottom of said cabinet outside said storage space, flexible connector means extending beneath said bottom of said cabinet to each said leg, said connector means being operably connected to each said leg for moving said vertically movable leg sections with respect to said stationary leg sections, power transfer means located beneath said bottom of said cabinet and connected to said power unit and operably connected to said flexible connector means for extending and retracting said flexible connector means, and means for controlling operation of said power unit whereby said vertically movable leg sections can be raised and lowered and the height of said patient support means above a support surface is selectively adjustable.

2. The examination table of claim 1 wherein said cabinet includes a plurality of rigid frame members below said bottom and said storage space of said cabinet interconnecting said legs and supporting said cabinet on said legs; said support means including support pan means secured to certain of said frame members beneath said bottom and said storage space of said cabinet for supporting said power unit and power transfer means beneath said bottom and storage space of said cabinet.

3. The examination table of claim 2 wherein said cabinet includes at least one extendible storage drawer at one end thereof and a variable use storage area at the other end; said support pan means being secured to said frame members such that said power unit is positioned generally intermediate and below said storage drawer and variable use storage area.

4. The examination table of claim 1 wherein said power unit is a reversible electric motor, said power transfer means including a rotatable screw and a connector member threaded on said screw for axial movement along said screw when it is rotated; said flexible connector means including an elongated, nonstretchable cable connected between the stationary section of each of said leg and said connector member on said screw and a plurality of pulleys mounted beneath said bottom and storage space of said cabinet for supporting each cable and directing each cable to its respective leg, at least one pulley being located adjacent each leg for directing its said cable upwardly, from beneath said bottom of said cabinet, and vertically alongside said leg to a point above said bottom of said cabinet where said cable is connected to said stationary section of said leg;

said cabinet and patient support means being raised by said screw and connector member when said motor is operated in one direction and lowered when said motor is operated in the reverse direction.

5. The examination table of claim 4 wherein said control means include a pendant, foot pedal control switch for controlling operation of said reversible electric motor.

6. The examination table of claim 1 wherein said flexible connector means include a flexible, nonstretchable cable connected between each of said legs and said power transfer means and a plurality of rotatable pulley means located below said bottom and storage space of said cabinet for supporting each of said cables.

7. The examination table of claim 6 wherein said power unit is a reversible electric motor; said power transfer means including a rotatable screw connected to said motor and a connector member threaded on said screw for axial movement therealong when said screw is rotated by said motor.

8. The examination table of claim 7 including a speed reduction gear box connected to said motor to rotate said screw at a speed lower than that of said motor and clutch means for transferring power from said motor and gear box to said screw.

9. The examination table of claim 8 wherein said control means include a pendant, foot pedal control switch for controlling operation of said reversible electric motor.

10. The examination table of claim 6 wherein each of said stationary leg sections is telescoped within one of said vertically movable leg sections, said vertically movable leg sections being positioned generally over and above said stationary leg sections; said pulleys for each of said cables including a first pulley at the bottom of each vertically movable leg section, an aperture in said vertically movable leg section adjacent said first pulley, and at least a second pulley for directing said respective cable to said power transfer means; each of said respective cables engaging its first and second pulleys, extending through said aperture in its vertically movable leg section and being fixedly secured to the top portion of said stationary, telescoping leg section whereby retraction of said power transfer means by said power unit simultaneously raises each of said vertically movable leg sections and thus said cabinet and patient support means.

11. The examination table of claim 1 wherein said patient support means includes an articulated patient support cushion having at least one pivotable cushion section and means for pivotally mounting said pivotable cushion section with respect to said cabinet top surface for generally vertical swinging movement to support a patient in various positions; a fluid cylinder pivotally connected between said cabinet top and the underside of said pivotable cushion section; and control means movable with said pivotable cushion section adjacent the end of said cylinder on the underside of said pivotable cushion section, said control means including handle means having portions extending laterally to either side of said cushion section and means operated by said handle means for depressing a valve controlling means on the end of said cylinder for controlling the position of said fluid cylinder whereby said cushion section position may be controlled from either side of said cushion section.

12. The examination table of claim 11 wherein said fluid cylinder includes a movable piston joined to a connecting rod, a valve in said piston to control the movement of fluid past said piston, and a push pin comprising said valve controlling means at one end of said connecting rod for opening and closing said piston valve to control the position of said piston and thus of said cushion section; said end of said connecting rod being pivotally secured to said underside of said pivotable cushion section adjacent said means operated by said handle means.

13. The examination table of claim 1 in which each said leg is exposed to the exterior of said cabinet for ease of access thereto; said cabinet end and side walls being suspended intermediate and between said legs.

14. The examination table of claim 13 wherein said power unit is a reversible electric motor, said power transfer means including a rotatable screw and a connector member threaded on said screw for axial movement along said screw when it is rotated; said flexible connector means including an elongated, nonstretchable cable connected between the stationary section of each of said leg means and said connector member of said screw and a plurality of pulleys located beneath said bottom and storage space of said cabinet for supporting each cable and directing each cable to its respective leg means from said connector member of said screw; said cabinet and patient support means being raised by said screw and connector member when said motor is operated in one direction and lowered when said motor is operated in the reverse direction.

15. The examination table of claim 14 wherein said flexible connectors extend directly to each of said legs from a portion of said power transfer means which is located at a generally common area at one end of said examination table; at least one of said flexible connectors extending diagonally beneath said cabinet from said portion of said power transfer means to a leg at the opposite end of said table.

16. A variable height examination table for supporting a patient during a medical examination comprising a cabinet; a plurality of leg means at spaced positions on said cabinet for supporting said table on a support surface, said cabinet including a bottom, side, and end walls, and patient supporting means mounted at the top of said cabinet for supporting a patient; each of said leg means including a stationary section adapted to rest on the support surface and a vertically movable section; and motive power means for raising and lowering said vertically movable leg sections, and thus said cabinet and patient support means, with respect to said stationary leg sections; said motive power means including a power unit, flexible connector means including at least one elongated, flexible connector connected to said leg means for moving said vertically movable leg sections with respect to said stationary leg sections, power transfer means connected to said power unit and flexible connector for extending and retracting said flexible connector; and means for controlling operation of said power unit whereby said vertically movable leg sections can be raised and lowered and the height of said patient support means above a support surface is selectively adjustable; said cabinet including a top; said patient support means including an articulated patient support cushion having at least one pivotable cushion section and means for pivotally mounting said pivotable cushion section with respect to said cabinet top surface for generally vertical swinging movement to support a patient in various positions; a fluid cylinder pivotally connected between said cabinet top and the underside of said pivotable cushion section; and control means movable with said pivotable cushion section adjacent the end of said cylinder on the underside of said pivotable cushion section, said control means including handle means having portions extending laterally to either side of said cushion section and means operated by said handle means for depressing a valve controlling means on the end of said cylinder for controlling the position of said fluid cylinder whereby said cushion section position may be controlled from either side of said cushion section; said fluid cylinder including a movable piston joined to a connecting rod, a valve in said piston to control the movement of fluid past said piston, and a push pin comprising said valve controlling means at one end of said connecting rod for opening and closing said piston valve to control the position of said piston and thus of said cushion section; said end of said connecting rod being pivotally secured to said underside of said pivotable cushion section adjacent said means operated by said handle means; a bracket secured to the underside of said cushion section and means in said bracket for engaging and pivotally supporting said push pin end of said connecting rod; said means operated by said handle means including a push pin engaging member rigidly secured to said handle means; biasing means for returning said push pin engaging member to its nonoperative position; and a stop for limiting the return movement of said engaging member whereby rotation of said handle means from either side of said cushion section depresses said push pin with said engaging member to control the position of said fluid cylinder piston, said handle means automatically returning to their nonoperative position when released.

* * * * *

UNITED STATES PATENT AND TRADEMARK OFFICE

CERTIFICATE OF CORRECTION

PATENT NO. : 4,057,240

DATED : November 8, 1977

INVENTOR(S) : Frank M. Damico & Raymond D. Nass

It is certified that error appears in the above-identified patent and that said Letters Patent are hereby corrected as shown below:

Column 1, line 27:
"3,34,951" should be --3,334,951--
Column 3, line 13:
"postions" should be --positions--
Column 3, line 50:
"one" (second occurrence) should be --on--
Column 5, line 50:
"of" should be --in--

Signed and Sealed this

Second Day of May 1978

[SEAL]

Attest:

RUTH C. MASON
Attesting Officer

LUTRELLE F. PARKER
Acting Commissioner of Patents and Trademarks